United States Patent [19]

Breslow

[11] 4,036,492

[45] July 19, 1977

[54] GAME APPARATUS

[75] Inventor: Jeffrey D. Breslow, Highland Park, Ill.

[73] Assignee: Marvin Glass & Associates, Chicago, Ill.

[21] Appl. No.: 630,721

[22] Filed: Nov. 10, 1975

[51] Int. Cl.[2] ..... A63F 9/00

[52] U.S. Cl. ..... 273/1 R

[58] Field of Search ..... 273/1 R, 130 R, 130 E, 273/152.1

[56] References Cited

U.S. PATENT DOCUMENTS

| | | | |
|---|---|---|---|
| 2,384,280 | 9/1945 | Cardoza | 273/152.1 |
| 3,339,921 | 9/1967 | Glass | 273/1 R |
| 3,582,075 | 6/1971 | Glass | 273/1 R |
| 3,841,628 | 10/1974 | Goldfarb | 273/1 R |
| 3,909,003 | 9/1975 | Rabinovich | 273/130 R |

*Primary Examiner*—William H. Grieb

*Attorney, Agent, or Firm*—Mason, Kolehmainen, Rathburn & Wyss

[57] ABSTRACT

A game apparatus which includes a game board having a plurality of positions defined thereon in a predetermined pattern. A set of playing cards is positionable at each position and each card has indicating means thereon the same as the remaining cards of that set but different from the cards of any other set. A master set of playing cards is provided and each card has indicating means thereon corresponding to the indicating means of one of the cards of the other plural sets thereof. A playing instrument is provided for each player of the game for at least partially covering one of the game board positions when a card of the master set is turned over and matches the corresponding card at said one position.

5 Claims, 4 Drawing Figures

GAME APPARATUS

BACKGROUND AND SUMMARY OF THE INVENTION

This invention is directed to a game apparatus which requires rapid visual observation in addition to manual dexterity on behalf of the players.

Games are provided which require participants of the game to visually observe the condition of certain of the game components and to react accordingly to perform a particular function. With the present invention, each player must rapidly visualize the occurrence of a particular circumstance, namely the matching of cards, and then utilize a structural implement to indicate a particular match.

More particularly, a game board is provided with a plurality of upstanding pegs arranged in a predetermined pattern. A set of playing cards are provided with apertures for positioning over each peg on the game board. Each set of playing cards has indicating means in the form of alphabetical indicia for positioning over the pegs in a predetermined pattern to define one or more words. A master set of playing cards is provided having indicating means thereon in the form of one or more letters of the alphabet corresponding to those positionable over the pegs. A playing instrument is provided for each player of the game for covering the pegs on the game board whenever a card from the master set is turned over and matches the corresponding card positioned over the peg on the board. The winner of the game is the first player to acquire cards from the game board so as to spell out the one or more words thereon. Of course, other indicating means such as particular numerical sequences could be provided for matching by the players of the game.

Other objects, features and advantages of the invention will be apparent from the following detailed description taken in connection with the accompanying drawings.

DETAILED DESCRIPTION OF THE PREFERRED EMBODIMENT

Figure 1:
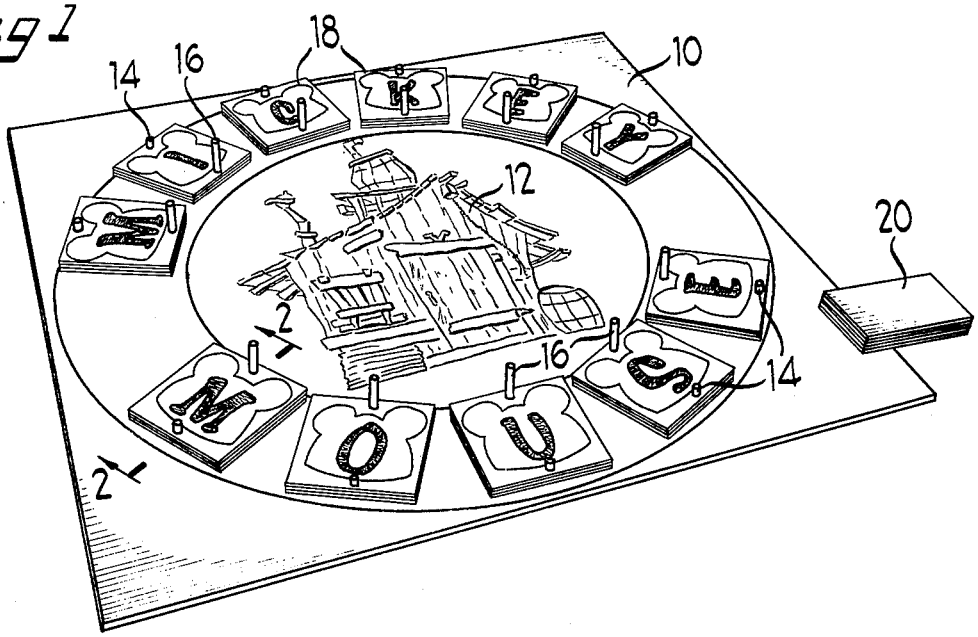
FIG. 1 is a perspective view of the game apparatus of the present invention including plural sets of playing cards at predetermined positions on a game board, along with a set of master cards described hereinafter.
Figure 2:
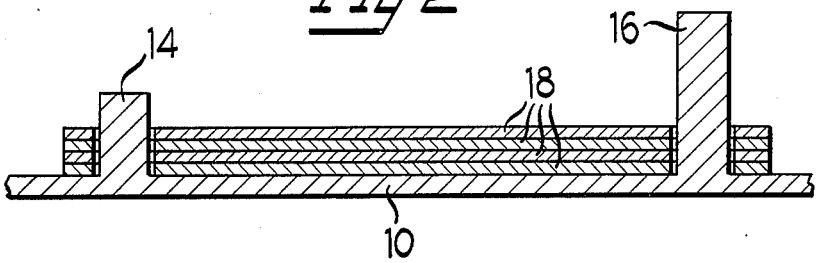
FIG. 2 is a fragmented vertical section, on an enlarged scale, taken generally along the line 2—2 of FIG. 1.

Referring to the drawings in greater detail, a generally flat game board 10 is provided with appropriate decoration 12, if desired, in the center thereof. The game board has a plurality of positions defined thereon in a predetermined pattern. In the embodiment of the invention shown in FIG. 1, the positions each are defined by a small outer upwardly protruding pin 14 in radial alignment with a taller inner pin 16. A set of playing cards 18 having complementary apertures for placing over the pins 14, 16 are positionable at each position defined thereby. The positions defined by the pins 14, 16 may be in a variety of patterns. As shown herein, the pattern is circular as seen in FIG. 1.

Each set of playing cards 18 at each position on the game board has indicating means the same for each set but different than that of any other set. The indicating means is designed to have a particular interpretation such as one or more words, a particular sequence of numbers, colors or the like. As shown herein, the positions on the game board defined by the pins 14, 16 are of a number so as to accommodate sets of playing cards 18 which spell out the word MICKEY MOUSE™. Of course, other indicating means such as other words, numerical sequences, color sequences, or the like, is contemplated by the present invention. The number of cards 18 in each set thereof for each position on the game board should be sufficient for at least one card for each player of the game. For instance, if four players are playing the game, four similar cards would be positionable at each position, as shown in FIG. 1.

Figure 3:
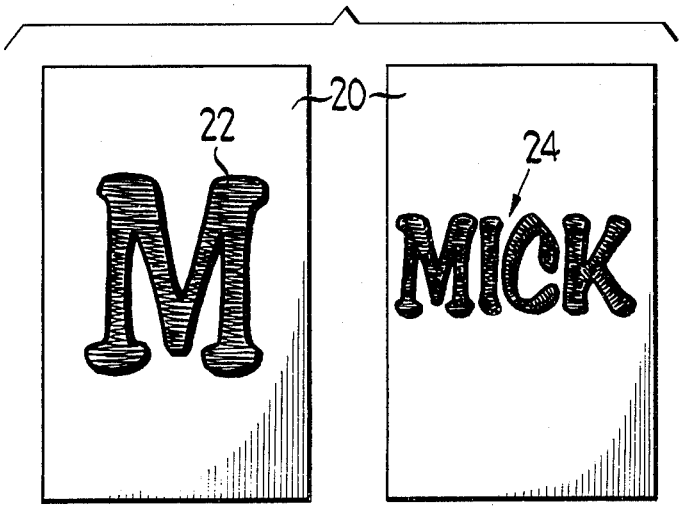
FIG. 3 is a top plan view, on an enlarged scale, of two of the master playing cards of the present invention.

A master set of playing cards 20 is provided and each card has indicating means thereon corresponding or identical to the indicating means on one of the cards 18 of the plural set thereof. For instance, as seen in FIG. 3, a lefthand master card 20 has indicating means 22 thereon forming the letter M corresponding to the first word in the name MICKEY MOUSE™. The righthand card 20 in FIG. 3 has indicating means, generally designated 24, which corresponds with a sequence of alphabetical letters (i.e., the first four) in the name MICKEY MOUSE™.

Figure 4:
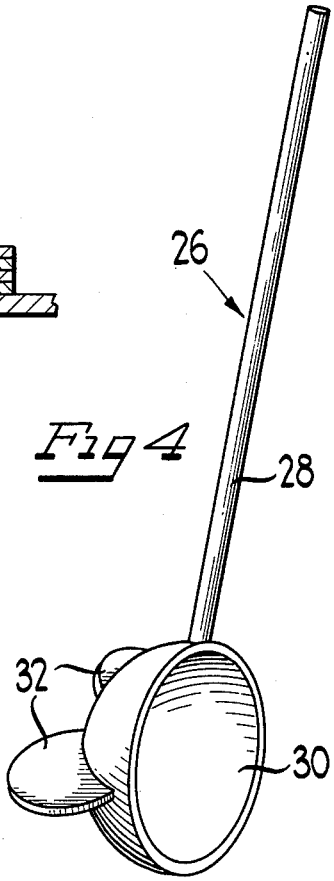
FIG. 4 is a perspective view of one of the playing instruments for each player of the game.

Referring to FIG. 4, a playing instrument, generally designated 26, is provided for each player of the game. The playing instrument 26 includes an elongated handle 28 which has a cup-shaped head portion 30 which may be provided in the shape of a mouse head having ears 32. The cup-shaped portion 30 preferably is of a size to be positionable over and cover the inner pins 16 on the game board 10.

During play of the game, the individual sets of playing cards 18 are arranged so as to be similar and are positionable on top of the respective pins 14, 16 defining the positions on the game board 10. The master set of playing cards 20 is shuffled and placed face down either on or adjacent the game board 10, as seen in FIG. 1. As play progresses, one of the master set of playing cards 20 is turned over, face up, so as to expose the indicating means thereon. The object of the game is for the players to utilize their playing instruments 26 to be the first player to cover the inner pin 16 of the game board 10 having playing cards 18 having indicating means corresponding to the indicating means on the master card 20 which just has been turned up. The first player to cover that pin 16 is entitled to acquire one of the cards 18 at that position. The first player to acquire one of each of the cards 18 from the plural sets thereof so as to spell out the specific words, arrive at a specific numerical sequence, etc. is the winner of the game.

Other ramifications of play can be provided by providing a playing card 20 having indicating means 24 such as that shown on the righthand card in FIG. 3. This card, as shown, can have a particular arrangement of letters either in a sequence or at random. The players thus could be required to cover a particular one of the sequence of letters or any one thereof on the game board in order to complete his collection of cards 18 to complete the pattern thereof positioned on the game board 10.

The foregoing detailed description has been given for clearness of understanding only and no unnecessary limitations should be understood therefrom as some modifications will be obvious to those skilled in the art.

I claim:

1. A game apparatus, comprising:

a game board having a plurality of playing positions thereon;

indicating means at said playing positions on the game board in the form of letters of the alphabet capable of combining to define at least one word;

upwardly protruding means at the playing positions for covering by players of the game; and a set of playing cards having alphabetical indicating means thereon identical to the indicating means at least at some of said playing positions on the game board whereby one player of the game can communicate the indicating means on a card from said set thereof and other players of the game can attempt to be the first to cover the upwardly protruding means at the particular playing position having indicating means thereat corresponding to the indicating means on the card so that the winning player can be awarded the card for spelling a word.

2. The game apparatus of claim 1 wherein the indicating means at said playing positions are arranged in a predetermined order so as to spell out at least one word on the game board.

3. The game apparatus of claim 2 wherein the indicating means on at least some of said playing cards comprises plural letter of the alphabet arranged in a pattern to spell out a part of the word defined on the game board.

4. The game apparatus of claim 2 wherein the indicating means on at least some of said playing cards comprises a single letter of the alphabet contained in the word defined on the game board.

5. The game apparatus of claim 1 including cupshaped playing instruments for the players of the game, the playing instruments being of a sufficient size to cover the upwardly protruding means at one of the playing positions on the game board.

* * * * *